US006786556B2

(12) United States Patent
Due

(10) Patent No.: US 6,786,556 B2
(45) Date of Patent: Sep. 7, 2004

(54) CONCRETE GRINDER APPARATUS

(76) Inventor: Joseph E. Due, 340 Grove St., Mauston, WI (US) 53948

( * ) Notice: Subject to any disclaimer, the term of this patent is extended or adjusted under 35 U.S.C. 154(b) by 0 days.

(21) Appl. No.: 10/167,776

(22) Filed: Jun. 10, 2002

(65) Prior Publication Data

US 2003/0127904 A1 Jul. 10, 2003

Related U.S. Application Data

(60) Provisional application No. 60/346,722, filed on Jan. 7, 2002.

(51) Int. Cl.[7] ..... B24B 23/08

(52) U.S. Cl. ..... 299/36.1; 451/344

(58) Field of Search ..... 451/344, 259, 451/340, 270; 299/36.1, 18, 39.2; 125/13.01; 15/49.1, 98

(56) References Cited

U.S. PATENT DOCUMENTS

| | | | | | |
|---|---|---|---|---|---|
| 2,417,620 | A | * | 3/1947 | Soderberg | 15/98 |
| 3,146,558 | A | | 9/1964 | Viescas | |
| 3,882,645 | A | * | 5/1975 | Duecker | 451/347 |
| 5,027,470 | A | * | 7/1991 | Takashima | 15/385 |
| 5,074,044 | A | | 12/1991 | Duncan et al. | |
| 5,287,660 | A | | 2/1994 | Bellati et al. | |
| 5,605,381 | A | | 2/1997 | Schmoock, Jr. et al. | |
| 5,637,033 | A | * | 6/1997 | Williams | 451/342 |
| 5,890,772 | A | * | 4/1999 | Mravyan | 299/41.1 |
| 5,908,224 | A | | 6/1999 | Santos | |
| 6,158,080 | A | * | 12/2000 | Schlapkohl | 15/301 |
| 6,238,277 | B1 | | 5/2001 | Duncan et al. | |
| 6,425,813 | B1 | * | 7/2002 | Ernst | 451/350 |
| 2003/0040265 | A1 | * | 2/2003 | Palushi | 451/350 |

* cited by examiner

*Primary Examiner*—David Bagnell
*Assistant Examiner*—Daniel P Stephenson
(74) *Attorney, Agent, or Firm*—Merchant & Gould P.C.

(57) ABSTRACT

A concrete grinding apparatus for use with a hand-held concrete grinder that can be detachably mounted in either a right-facing orientation or a left-facing orientation. The apparatus providing a variable wheelbase to modify grinder pressure acting upon a working surface. The apparatus further providing a mechanism to adjust the levelness of the hand-held grinder.

44 Claims, 11 Drawing Sheets

CONCRETE GRINDER APPARATUS

CROSS-REFERENCE TO RELATED APPLICATION

This application claims the benefit of Provisional Application Ser. No. 60/346,722, filed Jan. 7, 2002. Provisional Application Ser. No. 60/346,722 is herein incorporated by reference.

TECHNICAL FIELD

The principles disclosed relate to the operation and use of a concrete grinder. More particularly, this disclosure concerns a hand-held concrete grinder that is detachably mountable to a cart.

BACKGROUND

A wide variety of grinders are used to grind floors and working surfaces in the construction and remodeling industry. Some grinders are designed for grinding projects involving large working surfaces. Typical grinders designed for large working surfaces commonly have a grinding surface centrally mounted to a dolly. U.S. Pat. No. 5,908,224 discloses such a design having a grinder blade assembly centrally located beneath a housing. The structure of these conventional grinders typically requires the operator to provide adequate clearance between the device's grinding surface and wall structures leaving un-finished or un-ground working surface area along the wall.

Other grinders are designed for hand-held use and are smaller. The handheld grinders permit operation in close proximity of wall structures. Operators using larger grinders often have to complete work projects by using a hand-held grinder along the unfinished working surface areas left by the larger grinder. The hand-held grinders require the operator to move along the wall either on the operator's knees or in a bent-over position. This type of work activity is tiring and sometimes causes back or other injury to the operator.

In general, improvement has been sought with respect to concrete grinding arrangements, generally to accommodate ease of use of concrete grinders.

SUMMARY

One aspect of the present invention relates to a concrete grinder detachably mounted to a cart having a vacuum and a bag for dust and particle collection. Another aspect of the present invention relates to a concrete grinder having an adjustable wheel location. Yet another aspect relates to a mounting configuration that mounts a hand-held grinder in either a right-facing orientation or a left-facing orientation. Still another aspect of the present invention relates to a mounting device that pivotally adjusts the levelness of the hand-held grinder.

Yet another aspect of the present invention relates to a method for grinding concrete that preferably includes constructions as described above.

DETAILED DESCRIPTION

With reference now to the various figures in which identical elements are numbered identically throughout, a description of various exemplary aspects of the present invention will now be provided.

Figure 1:
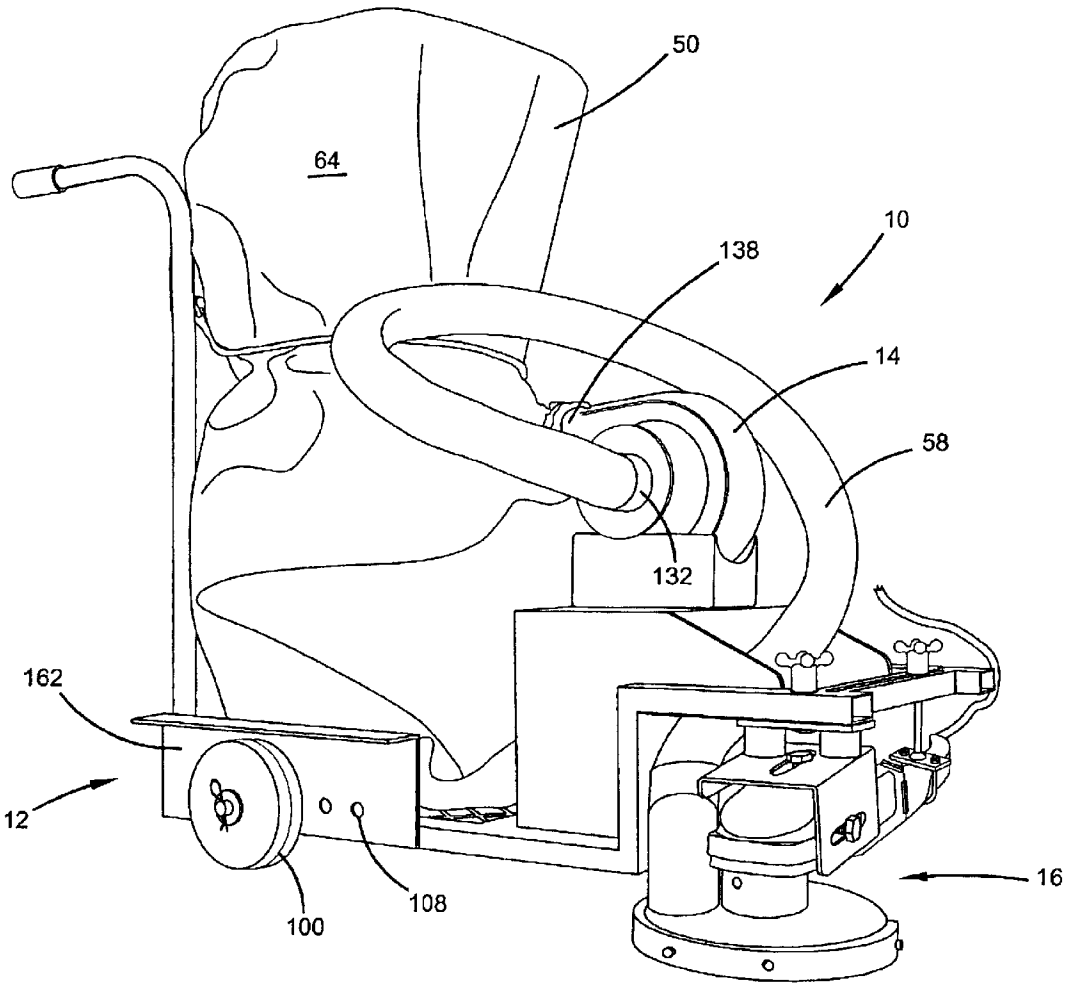
FIG. 1 is a front perspective view of one embodiment of a concrete grinder apparatus according to the principles of the present invention.

FIG. 1 illustrates a concrete grinder apparatus 10 that is an embodiment of the present invention. In general, the concrete grinder apparatus 10 includes a walk-behind structure, such as cart 12 (i.e., a carriage or dolly), a particle collection device, such as vacuum 14, and a grinder 16.

The cart 12 (best shown in FIGS. 2 and 3) comprises a main base 18 having a front region 20, a mid-region 22, and a rearward region 24. The main base 18 includes a base frame 26 (see FIG. 3) having a rear frame member 118, side frame members 120, a front frame member 122, and an intermediate frame member 124. The side frame members 120 are generally parallel to one another. The rear, front and intermediate frame members 118, 122, and 124 are generally perpendicular to the side frame members. The intermediate frame member 124 is located between the rear and front frame members 118 and 122.

In one non-limiting embodiment, the frame members are constructed of tubular steel, such as 2×1×0.125 inch rectangular steel tubing. A support structure 28 extends between side frame members 120 and between intermediate and rear frame members 118 and 124. The support structure 28 of the illustrated embodiment comprises a mesh structure. However, non-mesh supports could also be used.

Figure 2:
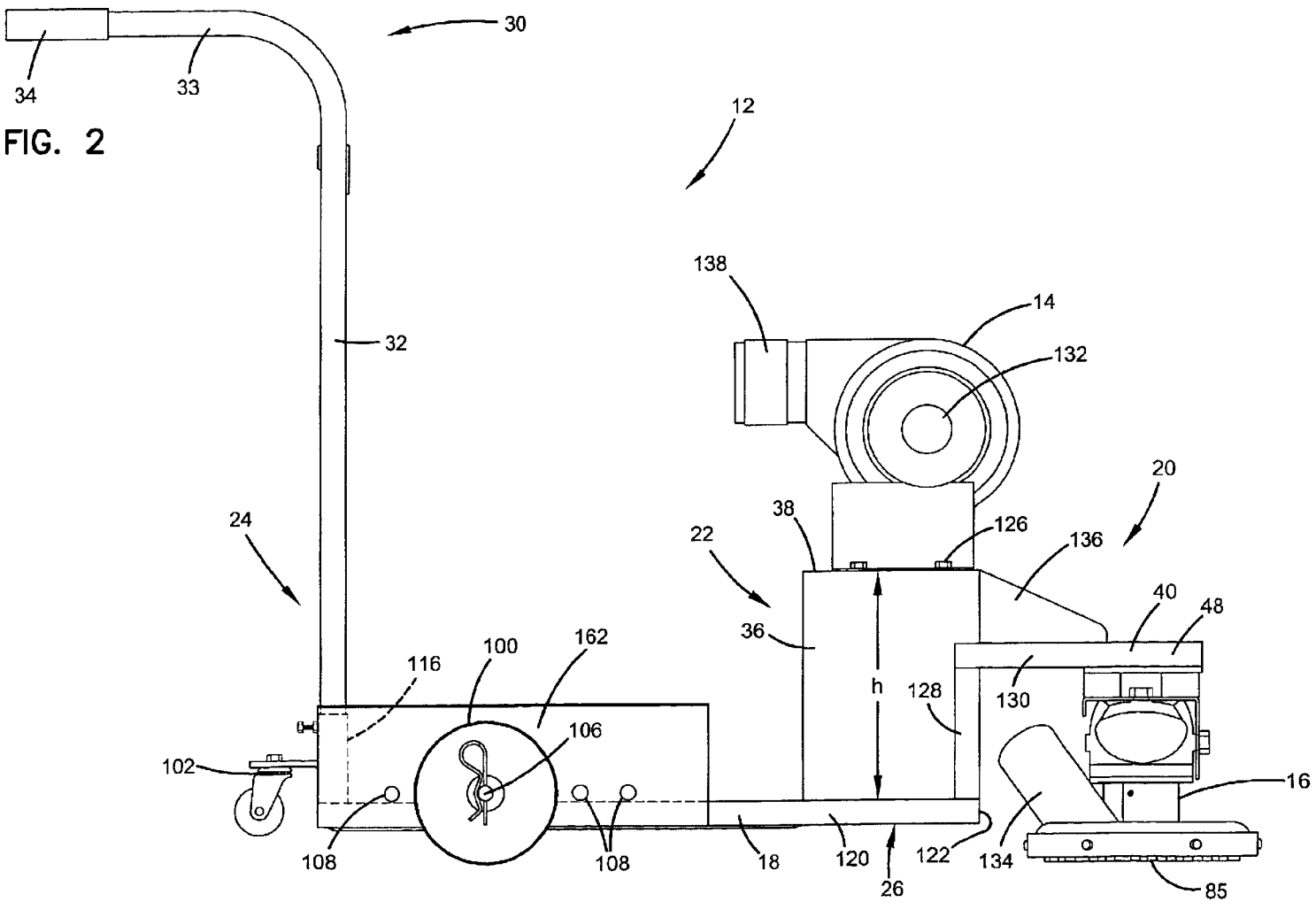
FIG. 2 is a right side elevational view of the concrete grinder apparatus of FIG. 1 without a collection bag.

Referring to FIG. 2, handles 30 are located at the rearward region 24 of the base 18. The handles include an extended portion 32 (i.e. vertical portion) connected to a bent or angled portion 33. The height of each handle 30 may be adjusted by raising or lowering each extended portion 32 to a desired position within handle tube supports 116 (shown in phantom). In the illustrated embodiment, the handle tube supports 116 are welded to the rear frame member 118 of the base frame 26. Grips 34 may be placed at the end of the angled portion 33.

Referring still to FIG. 2, the mid-region 22 includes a box structure 36. The box structure 36 extends upwardly from the intermediate and front members 124 and 122 and the side frame members 120. In the illustrated embodiment the box structure 36 comprises a rectangular configuration having a height h extending between the base frame 26 and a mounting platform 38. The height h of the box structure 36 can be varied to accommodate different vacuum models for reasons as will be discussed in greater detail hereafter. In the illustrated embodiment the height h is between about 8 and 11 inches. The mounting platform may include, for example, through holes (not shown) for receiving bolts 126 to mount the vacuum 14.

The vacuum 14 may be any type vacuum known to those of skill in the art that is adapted to generate suction sufficient to evacuate particles such as concrete pieces and concrete dust. The illustrated vacuum 14 includes a power switch 114 and electric power cord 112 (see FIG. 4A).

Referring again to FIGS. 2 and 3, the front region 20 of the cart 12 includes extension members 40 connected or welded at opposite ends of the front frame member 122. While any number of different materials could be used, the extension members 40 of the illustrated embodiment are of tubular steel. The extension members 40 include a first portion 128 and a second portion 130. As shown in FIG. 2, the first portion 128 is generally perpendicular to the base frame 26, and the second portion 130 is generally perpendicular to the first portion 128.

The extension members 40 are reinforced by flanges 136. Flanges 136 (see FIG. 2) extend forwardly from the box structure and couple to the second portion 130 of the extension members 40. The flanges 136 structurally support the extension members 40 to accommodate the load of the grinder 16. Additionally, the flanges provide structural rigidity so that the cart structure and the grinder 16 remain in true position relative to one another. Without proper structural support and rigidity, the cart may flex or twist under various loads resulting in an uneven grinding process.

Figure 3:
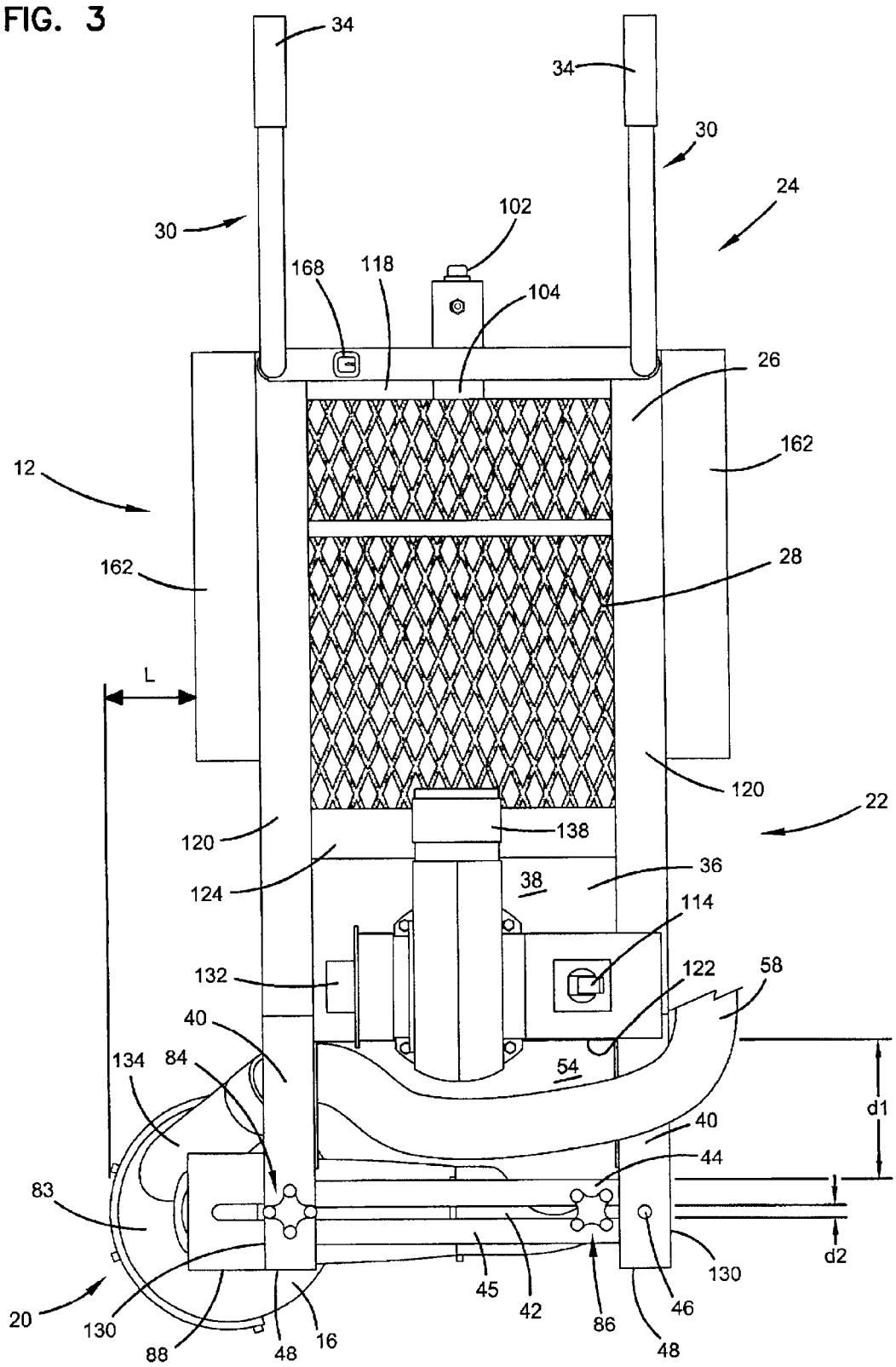
FIG. 3 is a top plan view of the concrete grinder apparatus of FIG. 2, showing the grinder in a right-facing orientation.

As shown in FIG. 3, a first and second transverse bars 44 and 45 are positioned between the extension members 40. The first transverse bar 44 is located a distance d1 from the box structure 36. The distance d1 defines a gap 54 and is generally sized so that a vacuum tube 58 can be routed from the grinder 16 to the vacuum 14, as will be discussed in greater detail. Preferably the distance d1 is within the range of 4 inches to 8 inches, more preferably about 6 inches.

The second transverse bar 45 is located a distance d2 from the first transverse bar 45. A transverse slot 42 defined by the distance d2 between the transverse bars 44 and 45 extends transversely between the extension members 40. The second portions 130 of the extension members 40 include holes 46 located near front ends 48 of the second portions 130. The slot 42 and the holes 46 permit an operator to detachably mount the grinder 16 to the cart 12 in either a right-facing orientation (shown in FIG. 3) or a left-facing orientation (shown in FIG. 7). The distance d2 is generally sized to accommodate a mounting structure as will be discussed in greater detail hereinafter. In one non-limiting embodiment, the distance d2 is about ½ inch.

When the grinder 16 is mounted in a right-facing orientation (shown in FIG. 3) the particle collection hose or vacuum tube 58 extends from the grinder 16, through the gap 54, and around the vacuum 14 to a vacuum port 132. In particular, the grinder 16 illustrated includes an exhaust port 134 that directs dust and debris in an inward and rearward direction (or inward toward the cart 12) when mounted in the right-facing orientation. The exhaust port 134 is part of a dust collector shroud 83 that covers a grinding disk 85 of the grinder 16. Without the gap 54, the vacuum tube 58 would kink and become damaged if an operator attempted to bend the vacuum tube 58 toward the vacuum port 132 along the right side of the cart 12. This configuration may accommodate a variety of current hand-held grinder configurations. As discussed in greater detail hereinafter, the gap 54 formed between the first transfer bar 44 and the box structure 56 also permits close operation of the apparatus near wall structures without interference from the vacuum tube 58.

When the grinder 16 is mounted in a left-facing orientation (shown in FIG. 7), the exhaust port 134 directs dust and debris in an inward and forward direction (or outward from the front of the cart 12). The vacuum tube may simply extend from the grinder 16 and route over the transverse bars 44 and 45 to the vacuum port 132.

Figure 7:
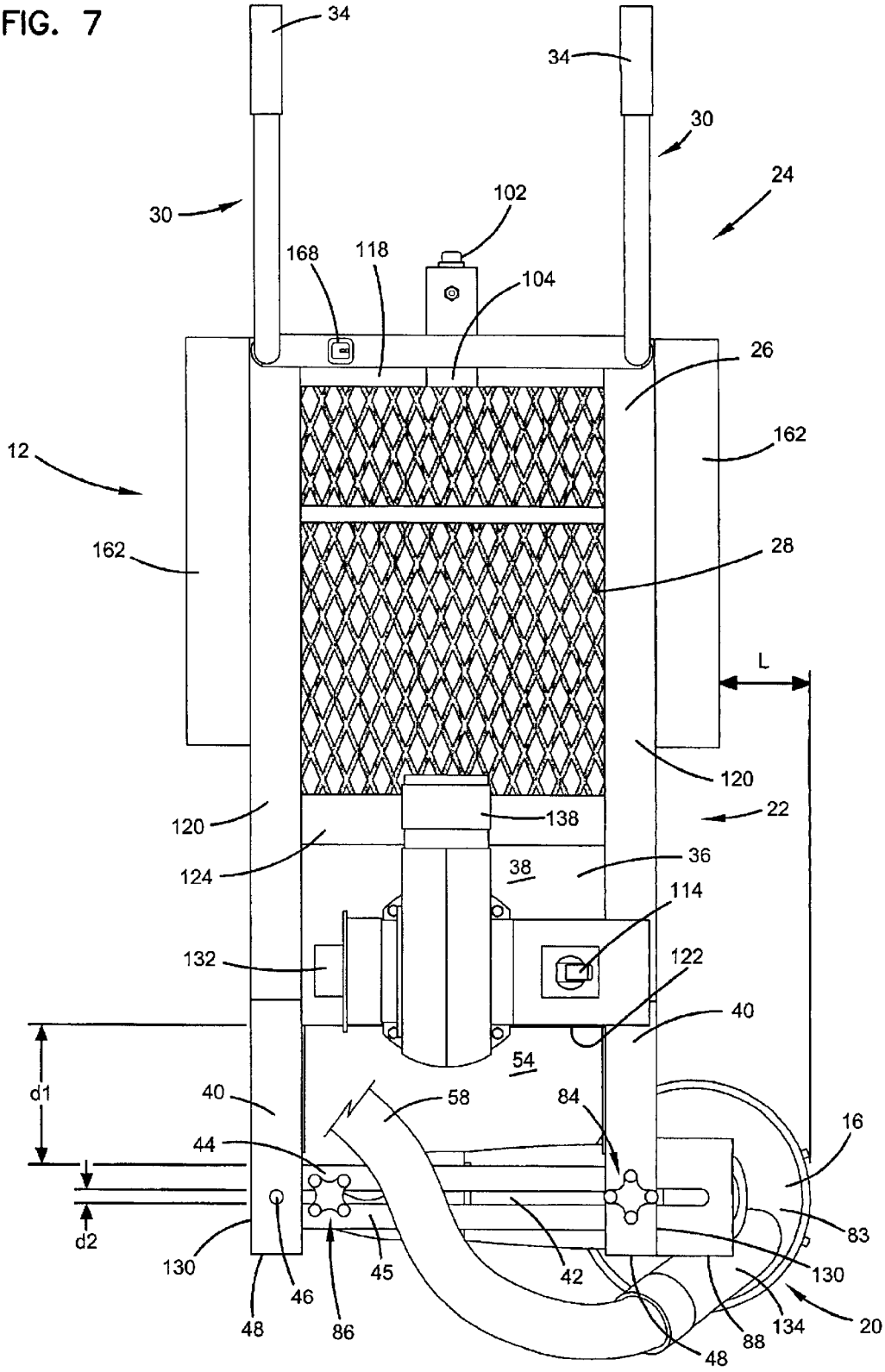
FIG. 7 is a top plan view of the concrete grinder apparatus of FIG. 2, showing the grinder in a left-facing orientation.

In either mounting orientation, the shroud 83 of the grinder 16 is the furthest laterally extending component of the apparatus 10. As shown in FIG. 3, the shroud 83 projects a lateral distance L beyond any other right side component of the apparatus 10. In one embodiment, L is in the range of about 5 inches. As shown in FIG. 7, the shroud 83 projects a lateral distance L beyond any other left side component of the apparatus 10. Thus, the arrangement as disclosed permits operation in areas close to a wall structure in either a right-facing orientation or a left-facing orientation.

Figure 6:
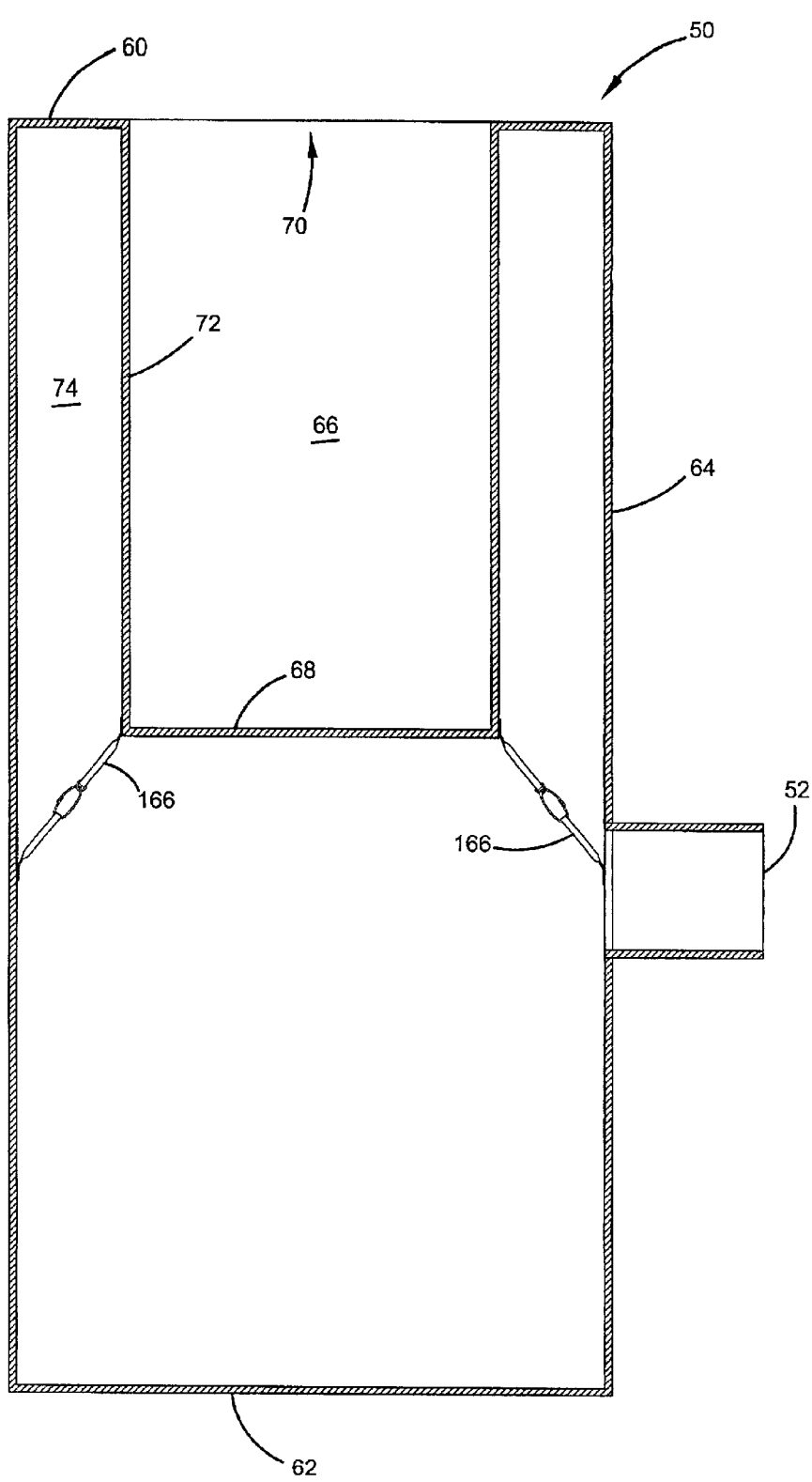
FIG. 6 is a cross-sectional view of the collection bag shown in FIG. 1.

Attached to the vacuum 14 is a collection bag 50. As best shown in FIG. 6, the collection bag generally includes top and bottom walls 60 and 62 and an outer side surface 64. A port 52 is located generally at a midpoint in the outer side surface 64 of the collection bag 50. The port 52 of the collection bag is designed to connect directly to the vacuum 14 at an exhaust port 138. This overall design eliminates the need for an additional vacuum tube to connect the vacuum exhaust port to the bag. In addition, the height h of the box structure 36 may be modified to accommodate various vacuum models having different height configurations so that the vacuum exhaust port may directly connect to the port 52 of the collection bag.

The collection bag 50 includes an internal pocket area 66. The internal pocket area 66 is formed in the top wall 60 of the collection bag. The internal pocket area 66 includes a bottom wall 68, a top opening 70, and an inner side surface 72. The inner side surface 72 of the illustrated embodiment is generally configured similar to the illustrated diametrical shape of the outer side surface 64, therein creating an annular gap 74 within the collection bag. The annular gap 74 is defined as the space between the bottom wall 68 and the top wall 60 of the collection bag. The annular gap configuration operates to maximize surface area of the collection bag to enhance the efficiency of the vacuum by resisting plugging and ensuring the free flow of air through the bag. The collection bag further includes tie straps or retaining elements 166 that prevent the pocket from blowing inside-out. The retaining elements maintain the pocket area 66 and annular gap 74 as the collection bag is filled.

In operation, the collection bag 50 is generally filled only to a level approximately adjacent the port 52. As the bag fills, the annular gap 74 provides the necessary airflow for maximum vacuum efficiency. The collection bag 50 is supported by the support structure 28 of the cart 12. The illustrated mesh base frame 26 illustrated also assists in creating more efficient vacuum operation by allowing air to flow through the support structure 28 to the bottom wall 62 of the collection bag 50. The mesh support structure also is more desirable for cleanliness purposes as less dust particles created by the grinding process collect on the mesh structure as opposed to collecting on a solid piece of sheet material.

The collection bag is preferably made from a cloth-like material that is lightweight for ease of handling, such as poly-felt. More preferably, the collection bag is made of poly-felt wherein the interior surface area of the poly-felt is heat-processed so that dust particles do not adhere to the internal surfaces of the collection bag.

Figure 4A:
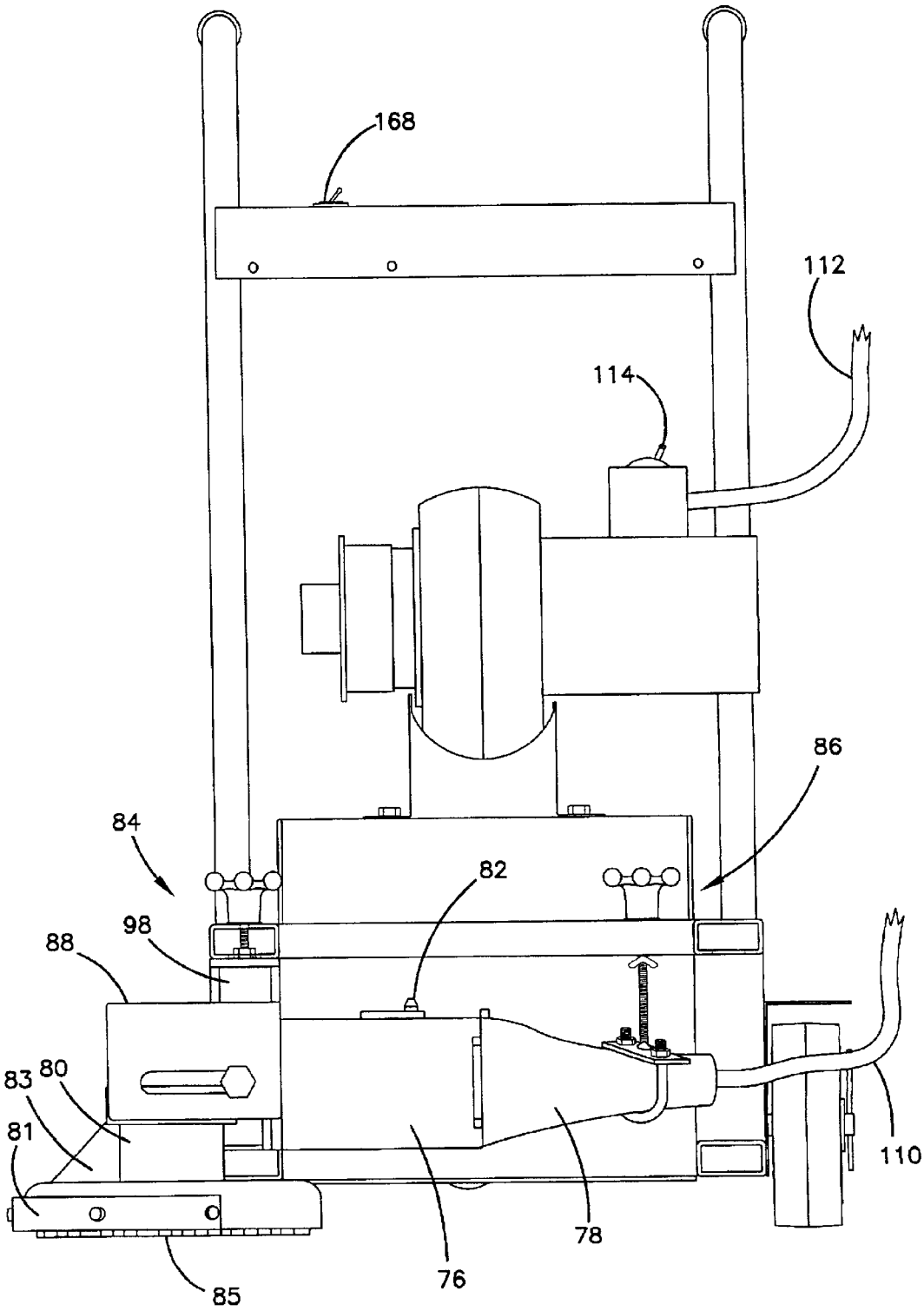
FIG. 4A is a front elevational view of the concrete grind apparatus of FIG. 3.
Figure 4B:
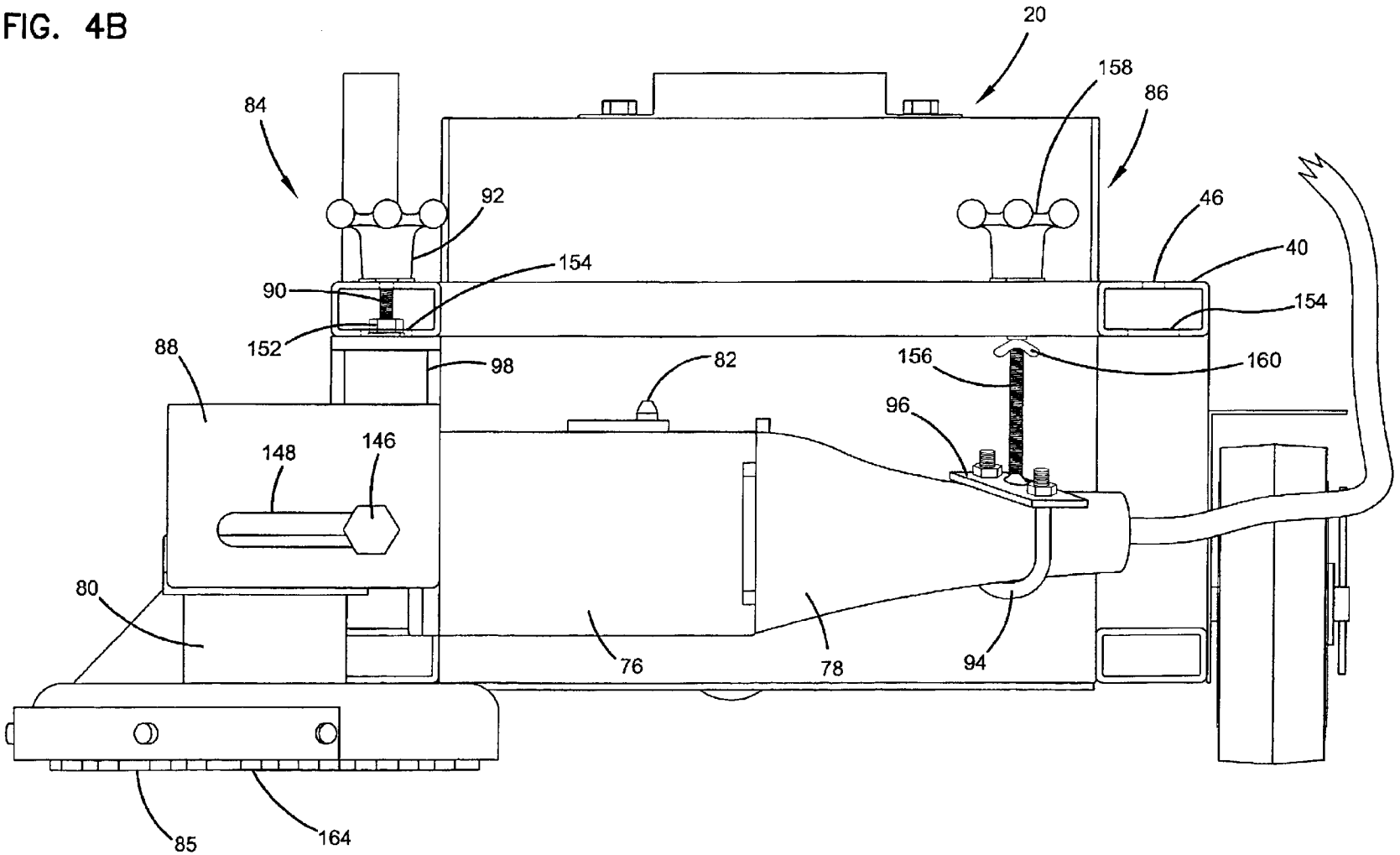
FIG. 4B is an enlarged front elevational view of the concrete grinder apparatus of FIG. 4A.
Figure 5:
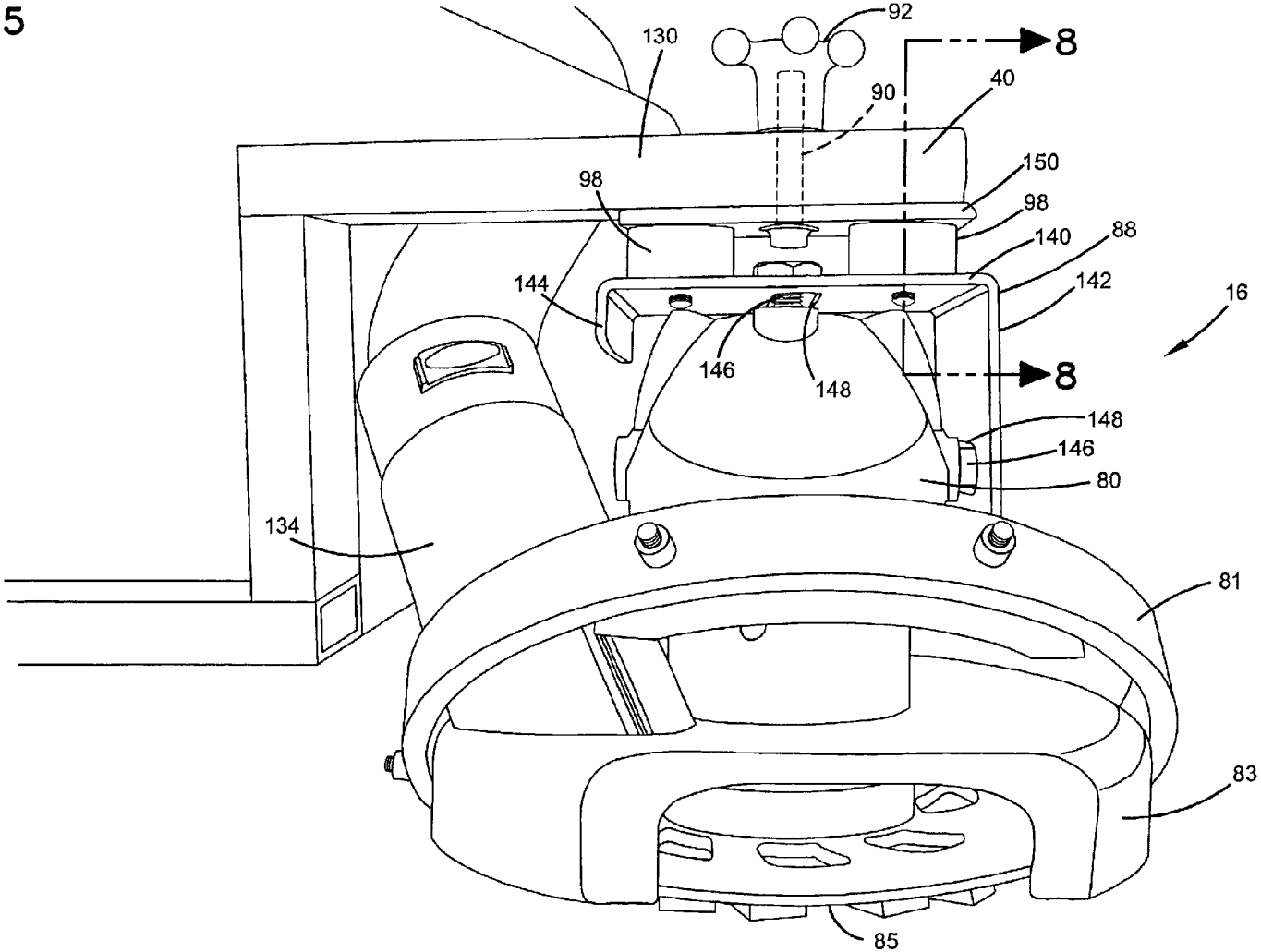
FIG. 5 is an enlarged right side elevational view of the concrete grinder apparatus shown in FIG. 4B.

Referring now to FIGS. 4A, 4B, and 5, the grinder 16 is detachably mounted to the front region 20 of the cart 12. The grinder 16 may include, for example, hand-held concrete grinders commonly found within the industry. What is meant by hand-held is that the device is capable of operating apart and separate from the cart.

In one embodiment, the hand-held concrete grinder illustrated is a hand-held grinder having a 7-inch diameter grinding surface. Suitable grinders are sold by Metabo Inc., of Germany. Such hand-held concrete grinders generally include a housing 76 having a handle 78, an electric motor within the housing 76, a grind head 80 powered by the electric motor, a dust collection shroud 83 that covers the grinding disk 85 driven by the grind head 80, an operating switch 82, and a power cord 110. The shroud 83 includes a pivoting outer shield 81 that can be pivoted upwardly to expose an edge of the grinding disk 85. Other hand-held configurations that can be detachably mounted to the cart may be used in accordance with the principles herein disclosed. While it is preferred to detachably mount grinders to the cart, permanent mounting configurations can also be used.

Referring to FIGS. 3, 4A and 4B, the illustrated hand-held grinder 16 is mounted to the front region 20 of the cart 16 by first and second attachment devices 84 and 86. The first attachment device 84 of the illustrated embodiment includes a head bracket 88 mounted to the grinding head 80 of the grinder 16. As shown in FIG. 5, the head bracket 88 has a center portion 140 and first and second side portions 142 and 144 extending downwardly from the center portion 140. In the illustrated embodiment, the first side portion 142 extends further downward than the second side portion 144. The reduced length of the second side portion 144 provides clearance for the housing 76 and exhaust port 134 of the grinder 16. The center portion 140 and the first side portion 142 of the head bracket 88 include slots 148 for adjustably mounting the grinder 16. Fasteners 146, such as bolts, detachably secure the head bracket 88 to the grinding head 80.

Figure 8:
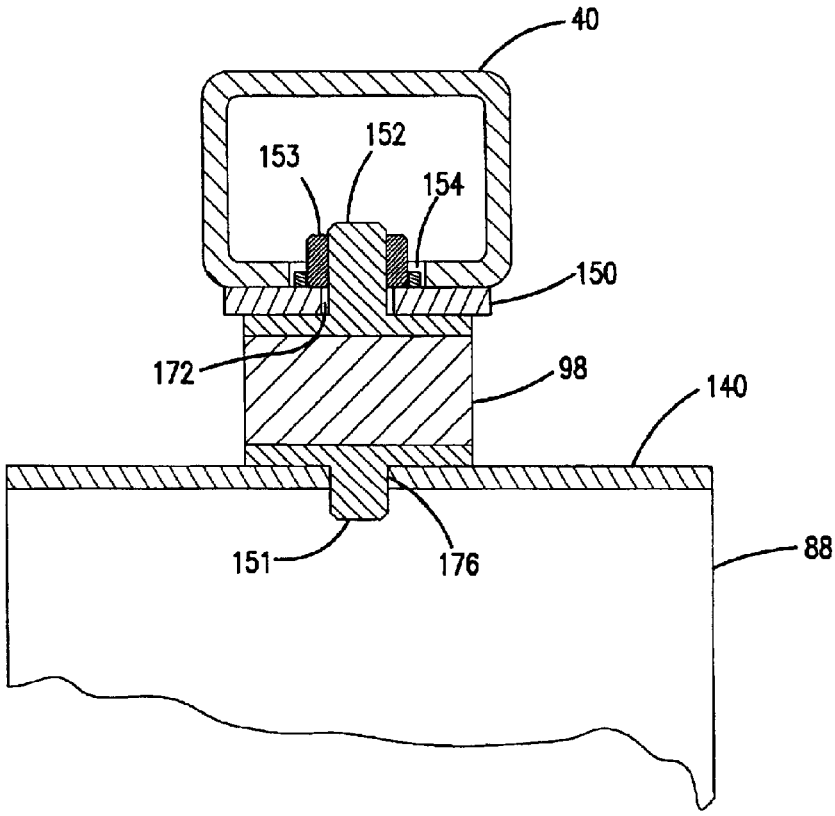
FIG. 8 is a cross-sectional view taken along line 8—8 of FIG. 5.

As shown in FIGS. 5 and 8, dampening members or isolators 98 are located between the head bracket 88 and an adapter bracket 150. Two fasteners 151 and 152 extend from opposite ends of the isolators 98. The bottom fastener 151 of each isolator 98 threads into a threaded hole 176 located in the head bracket 88. The top fastener 152 of each isolator 98 extends through a clearance hole 172 in the adapter bracket 150 and is secured to the adapter bracket by a nut 153.

In assembly, the isolators 98 are compressed between the adapter bracket 150 and the head bracket 88. The isolators 98 may be made, for example, of a rubber material. In the preferred embodiment, the fasteners 151 and 152 are molded into the opposite ends of the isolators 98. This construction defines a central flexible region of the isolator that permits the operator to pivot the handle 78 of the grinder housing 76 when adjusting the angle of the grinding head as described in greater detail hereinafter. The isolators 98 also function as shock absorbers to dampen vibrations experienced from operation of the grinder 16 on uneven or rough surfaces. Other isolator configurations, such as buffer elements, padding, or other non-rigid or resilient components known to those of skill in the art may be adapted for use in accordance with the principles disclosed.

Preferably the adapter bracket 150 includes a threaded extension 90 (shown in phantom in FIG. 5) welded to the bracket 150. The threaded extension 90 extends upward through a hole 46 (shown in FIG. 3) in the second portion 130 of the extension member 40. A threaded cap 92, corresponding to the threaded extension 90, secures the adapter bracket 150 to the cart. Thereby, the isolators 98, head bracket 88, and grinder 16, which are secured to the adapter bracket 150, are also securely assembled to the cart. Clearance holes 154 are provided in the tubular extension members 40. The clearance holes 154 are sized to accommodate clearance for the fasteners 152 and the nuts 153 that secure the isolators 98 to the adaptor bracket 150. The clearance holes 154 are formed in both of the tubular extension members 40 to permit assembly of the grinder 16 in either a left-facing arrangement or right-facing arrangement.

The second attachment devise 86 includes a U-bolt 94 and U-bolt adapter bracket 96. The U-bolt 94 may include any type of common U-bolt or other fastener configured to retain the handle 78 of the grinder housing 76. The U-bolt extends around the handle 78 and each of the ends is threaded through corresponding holes (not shown) in the U-bolt adapter bracket 96. The U-bolt adapter bracket also includes a threaded extension 156 welded to the bracket 96. In the illustrated embodiment, the threaded extension 156 extends upward through the slot 42 formed between the transverse bars 44 and 45. This arrangement provides an operator with flexibility in mounting various sized grinders to the front region of the cart. A threaded cap 158 and a wing nut 160 secure the U-bolt adapter bracket 96 and handle 78 in place. In particular, by tightening the cap 158, the transverse bars 44 and 45 are clamped between the cap 158 and the nut 160.

One feature of the grinder mounting arrangement is that the grinding angle of the grinder 16 can be adjusted. Adjusting the angle of the grinder permits an operator to alter the levelness or flatness of a bottom grinding surface 164 of the grinder 16. To illustrate, preferably an operator fixes the head bracket 88 in a stationary position. The angle of the grinding head 80 may be set in a desired orientation by moving the end of handle of the housing either upward or downward. Adjusting the threaded bolt 156 relative to the bars 44, 45, controls the upward or downward movement of the handle thereby changing the angle of the grinding head. The isolator functions to permit the handle to flexibly pivot while still providing a sufficient structure to securely fix the grinder in position. The increment of adjustment is vast as the adjustment is determined by adjusting the threads of the second attachment device 86. Once aligned, the grinding head is locked into position by tightening the threaded cap 158 and wing nut 160. Also, the wing nut 160 may be positioned to provide a set upward movement boundary (i.e., a positive stop). The threaded cap 158 may then be used to provide a range of movement up to the upward boundary. The arrangement as disclosed permits an operator to change the grinder alignment as the operator moves along uneven surfaces requiring such adjustments.

In an alternative arrangement, the angle of the grinding head may be adjusted by the operator from the rearward region 24 of the cart 12 by adapting a crank linkage (not shown) to the apparatus. The crank linkage may replace or work in conjunction with the threaded cap 158 of the second attachment device 86. Such crank linkages typically include a knuckle, an extension arm, and a crank that cooperatively operate to adjust the position of the grinder handle 78.

The hand-held grinder 16 may be mounted either toward the right side or the left side of the cart. The grinding head 80 preferably projects leftward or rightward beyond the side of the cart 12 so that an operator can see the grinder while standing behind the cart; and so that the operator can use the cart on a surface area adjacent a wall structure without the cart interfering with the wall structure. In addition, the laterally offset location of the grinder 16 addresses limitations in routing the rearwardly extending vacuum tube 58 from the grinding head 80.

The vacuum tube 58 is connected between the concrete grinding head 80 and the port 132 of the vacuum 14. The vacuum is connected to the port 52 of the collection bag 50. In one embodiment, the grinder power cord 110 and the vacuum power cord 112 are plugged into a power source, such as an outlet or an extension cord, to operate the grinder 16 and vacuum 14. Preferably, the power cords 110 and 112 are electrically connected to a main switch 168 (shown in FIG. 4A) that operates both the vacuum and grinder simultaneously or separately.

Figure 9:
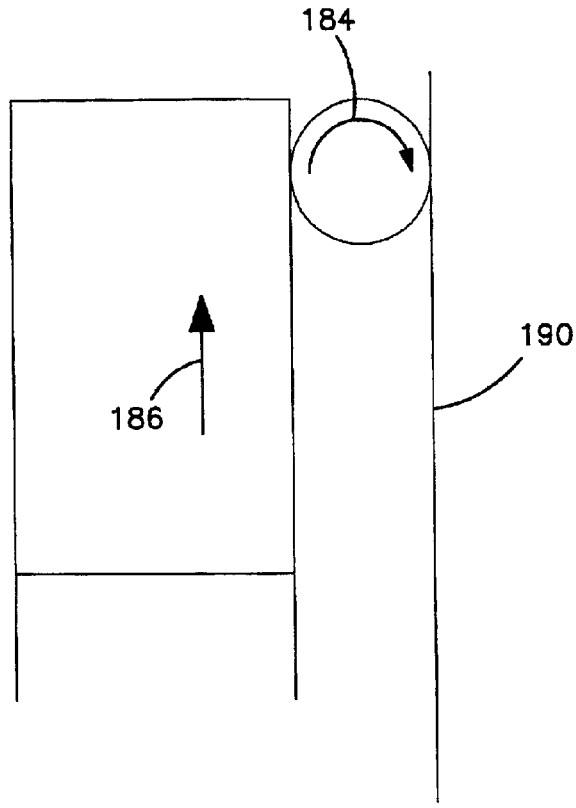
FIG. 9 is a schematic illustration of the concrete grinder of FIG. 3.

FIG. 9 schematically illustrates the apparatus when operated in the right-facing orientation. The rotational action of the grinding surface (indicated by arrow 184) acts to bias the cart toward the wall 190 and assists the operator in guiding the grinding surface 164 close along the wall structure. For some applications, the pivoting shield 81 of the grinder 16 can be pivoted upward (as shown in FIG. 5) to permit even closer grinding operation. With the shield 81 pivoted upward, contact between the edge of the grinding disk 85 and the wall causes the cart 12 to be propelled in a forward direction away from the operator as indicated by arrow 186.

Figure 10:
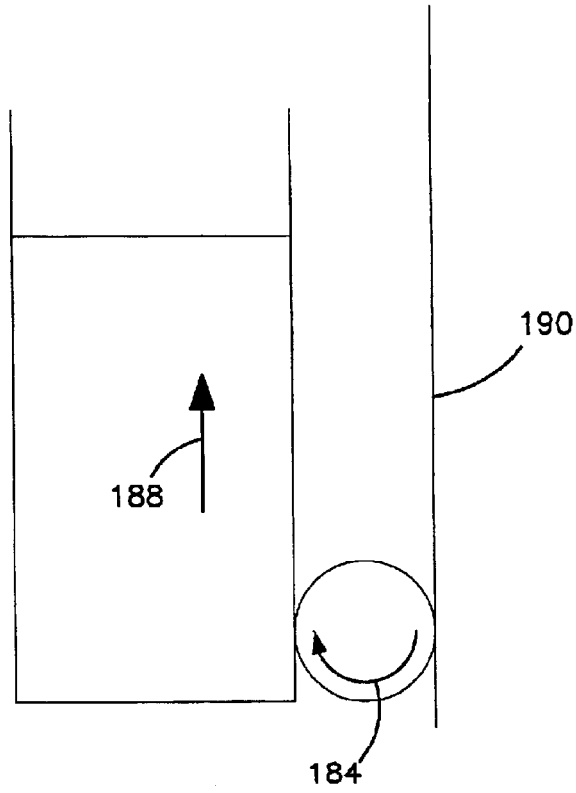
FIG. 10 is a schematic illustration of the concrete grinder of FIG. 7.

FIG. 10 schematically illustrates the apparatus when operated in the left-facing orientation. When operated in this left-facing orientation, it is preferred to pull the cart in a direction indicated by arrow 188 along the wall 190. The rotational action of the grinding surface (indicated by arrow 184) again acts to bias the cart toward the wall 190 and assists the operator in guiding the grinding surface 164 close along the wall structure. For some applications, the pivoting shield 81 of the grinder 16 can be pivoted upward (as shown in FIG. 5) to permit even closer grinding operation. With the shield 81 pivoted upward, contact between the edge of the grinding disk 85 and the wall causes the cart 12 to be propelled in a rearward direction toward the operator as indicated by arrow 188.

Referring back to FIGS. 1 and 2, the cart 12 includes a variable wheelbase having side flanges 162 located on either sides of the cart. Each of the flanges 162 has a plurality or series of holes 108. Each hole 108 on one of the side flanges 162 corresponds to an aligned hole on the opposite side flange. An axle 106 extends between and through two aligned holes 108. Wheels 100 are connected to the axle 106. The series of holes 108 are positioned along the side flanges so that the axle 106 may be selectively located either closer to or farther from the front region 20 of the cart 12.

In an alternative arrangement, the flange may comprise a slot (not shown) so that the axle may be selectively positioned along the slot. The slot may also include upward recesses or indents into which the axle could seat. It is further contemplated that the cart may include a device that automatically moves the axle along the slot, such as, for example, a piston and cylinder device, an electric motor device, or a crank-type device.

Figure 11:
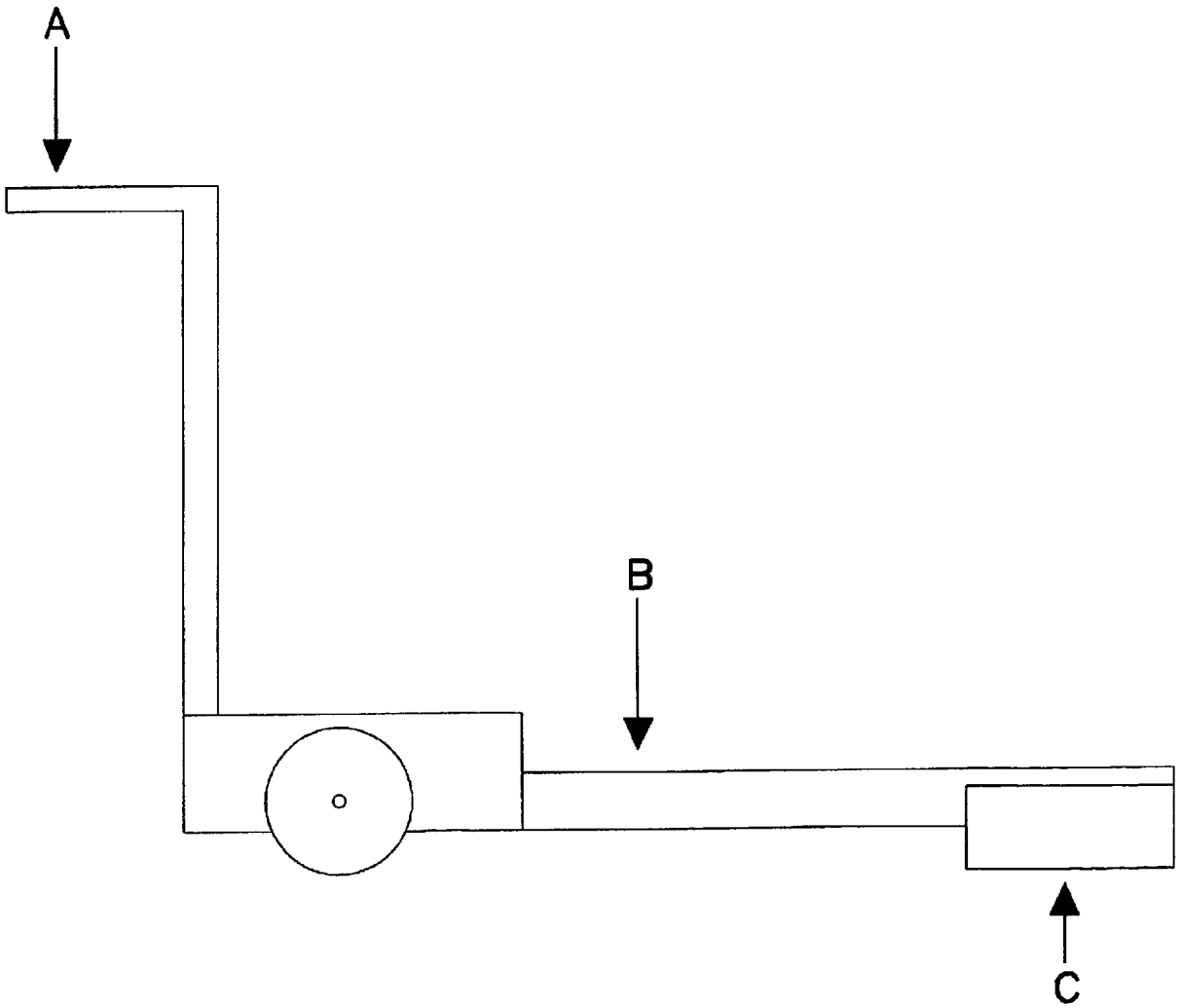
FIG. 11 is a free body diagram of the concrete grinder of FIG. 1.

When operated, dust and concrete particles loosened and removed from a concrete floor are suctioned through the vacuum tube 58 and exhausted into the collection bag 50. The collection bag 50 is positioned upon the support structure 28 of the base frame 26. The axle 106 acts as a fulcrum. In use, the apparatus preferably contacts the ground at only 3 locations namely the two wheels 100 and the grinding disk 85. As schematically shown in FIG. 11, forces acting to generate torque about the fulcrum include force A applied to the handles by the operator, force B which represents the weight of the cart (including the dust bag) positioned in front of the fulcrum, and force C applied to the grinding disk by the ground. Force C can be increased by pulling up on the handles and decreased by pushing down on the handles. Force B increases as the dust bag fills. To maintain constant grinding force at the grinding disk, the axle 106 can be moved forwardly (as described below) as the bag fills with dust.

An additional force affecting the grinding head pressure applied to the working surface is the accumulating weight of the collection bag 50. As the collection bag 50 fills with dust and concrete particles, the grinding head pressure applied to the working surface changes. The axle 106 and wheels 100 may be moved either forward or backward along the hole series to change the fulcrum point, and in essence the length of the lever arm, to adjust the grinding head pressure. For example, when initially beginning a concrete-grinding project, an operator may selectively position the wheels 100 at a first location. At this first location, the wheels act as a fulcrum applying a first pressure proportional to the weight of the cart and empty collection bag. As the collection bag fills and become heavier, the operator may adjust the wheel to either lessen or increase the pressure on the grinding head to compensate for the pressure differential due to the change in moment caused by the increasing weight of the bag. Thus, in operation, as the pressure changes, the operator can adjust the fulcrum point to therein readjust to the grinding head pressure.

Yet another feature of the present disclosure relates to transporting the cart. A swiveling caster wheel 102 (shown in FIGS. 2 and 3) is located at a central back location 104 along the rear frame member 118 of the base 18. The caster wheel 102 functions as a stop. When the front region of the cart 12 is tilted upward for transport the caster wheel 102 prevents the base frame from contacting and potentially gouging the working surface. Other types of wheels, such as non-swiveling casters or wheels or even members adapted to slide across the floor (e.g., a plastic wear-resistant slide member) rather than roll that prevent the base from contacting the working surface may be used.

As described previously, the hand-held grinder 16 may be mounted either toward the right side or the left side of the cart. In addition, the grinder 16 may be angled to adjust the grinder in relation to the levelness of the floor. Also, the wheelbase may be moved forward or backward from an initial fulcrum point to adjust the grinding head pressure. The disclosed apparatus is designed to accomplish all these adjustments and variations without the use of tools.

While the movable axle herein described is preferred, the movable axle is not required. Similarly, while the pivoting adjustable grinding head and the left and right mounting capability of the present disclosure is preferred, these features are not required. Likewise, the overall mounting configuration can be changed to accommodate a variety of devices requiring a variety of detachable mounting configurations.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A grinding apparatus comprising:

a) a cart having a front end and a back end;

b) a hand-held grinder mounted to the cart, the hand-held grinder being removable from the cart as a separate, operable unit, the hand-held grinder including:

i) an elongated housing having a handle portion;

ii) a grind head interconnected to the elongated housing; and iii) an operating switch electrically connected to a power cord;

c) handles located at the back end of the cart;

d) a vacuum mounted on the cart between the front and back ends; and e) a vacuum bag support located between the front and back ends of the cart.

2. The grinding apparatus of claim 1, wherein the vacuum bag support comprises a mesh platform.

3. The grinding apparatus of claim 1, wherein the vacuum is mounted on a base that is raised relative to the vacuum bag support.

4. The grinding apparatus of claim 3, further comprising a bag supported on the vacuum bag support and connected directly to the vacuum.

5. The grinding apparatus of claim 4, wherein the bag further includes an internal pocket.

6. The grinding apparatus of claim 5, wherein the internal pocket defines an annular ring within the bag, the annular ring having an external surface area and an internal surface area through which airflow is communicated to increase operational efficiency of the vacuum.

7. The grinding apparatus of claim 1, wherein the cart includes a mounting configuration for mounting the hand-held grinder in either a left-facing orientation or a right-facing orientation.

8. The grinding apparatus of claim 1, wherein hand-held grinder can be pivoted relative to the cart to vary a grinding angle of the grinder.

9. The grinding apparatus of claim 1, further comprising a resilient member mounted between the hand-held grinder and the cart for allowing grinder to be pivoted.

10. The grinding apparatus of claim 1, wherein the hand-held grinder is mounted adjacent the front end of the cart, and wherein the cart includes wheels positioned adjacent the rear end of the cart, the wheels defining a fulcrum axis of the cart.

11. The grinding apparatus of claim 10, wherein during use, the apparatus contacts the ground exclusively at the grinder and the wheels defining the fulcrum axis.

12. The apparatus of claim 1, wherein the cart includes wheels defining a fulcrum axis.

13. The apparatus of claim 12, wherein the vacuum bag support is positioned between the fulcrum axis and the front end of the cart, wherein a vacuum bag is supported at the vacuum bag support, wherein the hand-held grinder is positioned adjacent the front end of the cart, and wherein a grinding pressure at the grinder increases as the vacuum bag fills.

14. The apparatus of claim 13, wherein the wheels are movable to change the location of the fulcrum axis.

15. The grinding apparatus of claim 1, wherein the hand-held grinder extends beyond a side of the cart to permit operation of the grinder adjacent a wall without interference between the wall and the grinding apparatus.

16. The grinding apparatus of claim 1, wherein the vacuum includes a tubing connected between the hand-held grinder and the vacuum for transport of particles loosened by the grinder.

17. The grinding apparatus of claim 16, wherein the cart further includes a gap located adjacent the front end of the cart, the gap configured to accommodate the tubing so that the hand-held grinder can be mounted to extend beyond a side of the cart without interference between a wall and the grinding apparatus during operation of the grinding apparatus adjacent the wall.

18. The grinding apparatus of claim 1, further including a transport wheel located adjacent the back end of the cart, the transport wheel being positioned to contact a working surface when the front end of the cart is tipped upward, wherein the transport wheel prevents the back end of the cart from contacting the working surface.

19. The grinding apparatus of claim 1, further including a mounting arrangement that detachably mounts the hand-held grinder to the front end of the cart.

20. The grinding apparatus of claim 19, wherein the mounting arrangement includes a first mounting mechanism and a second mounting mechanism, the first mounting mechanism fixedly mounting one end of the grinder in a laterally offset position from the cart, the second mounting mechanism being adapted to pivotally position an opposite end of the grinder at a selected vertical position to adjust the flatness of a bottom grinding surface of the hand-held grinder.

21. The grinding apparatus of claim 20 wherein the first mounting mechanism further includes at least one flexible member that accommodates the pivotal movement of the opposite end of the hand-held grinder to adjust the flatness of the bottom grinding surface.

22. A grinding apparatus for grinding a working surface, the grinding apparatus comprising:

a) a cart having a front region and a rear region, the cart including:

i) a base having a first side and a second side extending between the front and rear regions;

ii) at least one handle located at the rear region of the cart; and iii) a moveable wheel coupled to an axle;

b) a grinder mounted at the front region of the cart, the grinder including a bottom grinding surface; and c) a vacuum assembly mounted between the front region and the rear region of the cart, the vacuum assembly including a collection structure;

d) wherein the moveable wheel is positionable in a plurality of locations, including a first location wherein a majority of the collection structure of the vacuum is positioned forward of the axle and a second location wherein the majority of the collection structure of the vacuum is positioned rearward of the axle.

23. The grinding apparatus of claim 22, wherein the axle mounting locations further include at least a first and a second hole located along the first side of the base and at least a first and a second hole located along the second side of the base.

24. The grinding apparatus of claim 23, wherein the first hole along the first side of the base corresponds to the first hole along the second side of the base, the corresponding first holes defining a first axle mounting location.

25. The grinding apparatus of claim 24, wherein the first axle mounting location defines a first fulcrum, the first fulcrum acting to transfer forces acting upon the cart to the bottom grinding surface of the grinder.

26. The grinding apparatus of claim 22, wherein the axle mounting locations define a range of fulcrum locations, each fulcrum location acting to transfer forces acting upon the cart to the bottom grinding surface of the grinder.

27. The grinding apparatus of claim 26, wherein one of the forces acting upon the cart is the accumulating weight of the collection bag.

28. A cart for using with a hand-held grinder, the cart comprising:

a) a frame including a left side and a right side;

b) a grinder mount for securing the hand-held grinder to the frame, the grinder mount being configured to allow the grinder to be mounted in either a left-facing or right-facing orientation.

29. The cart of claim 28, wherein the grinder mount includes a first mounting mechanism and a second mounting mechanism, the first mounting mechanism fixedly mounting one end of the hand-held grinder in a position laterally offset from the left or right side of the cart.

30. The cart of claim 29, wherein the second mounting mechanism is adapted to pivot an opposite end of the hand-held grinder to a selected vertical position to adjust a mounted angle of the hand-held grinder.

31. The cart of claim 30, wherein the first mounting mechanism includes at least one flexible member that accommodates the pivotal movement of the opposite end of the hand-held grinder to adjust the mounted angle of the hand-held grinder.

32. The cart of claim 28, wherein the grinder mount includes a resilient member mounted between the hand-held grinder and the frame for allowing grinder to be pivoted.

33. A method of grinding a concrete working surface, the method comprising:

a) providing a grinding apparatus, the grinding apparatus including:

i) a cart;

ii) a grinder; and iii) a vacuum and a bag;

b) selecting one of a left-facing orientation and a right-facing orientation in which to mount the grinder;

c) mounting the grinder in the selected orientation.

34. A method of grinding a concrete working surface, the method comprising:

a) providing a grinding apparatus, the grinding apparatus including:

i) a cart having a front region and a rear region, the cart including:

1) a plurality of axle mounting locations positioned adjacent the rear region of the cart;

2) an axle configured to cooperate with each of the plurality of axle mounting locations; and 3) wheels mounted to the axle;

ii) a grinder mounted to the front region of the cart;

iii) a vacuum and a bag, the bag being located at the rear region of the cart, the bag being in communication with the vacuum, the vacuum being in communication with the grinder;

iv) wherein the wheels and axle are positionable in one of the plurality of axle mounting locations, including locations wherein a majority of the bag is positioned forward of the axle and locations wherein the majority of the bag is positioned rearward of the axle;

b) selecting a first axle mounting location and positioning the axle and wheels at a first selected axle mounting location;

c) operating the grinding apparatus;

d) monitoring the contents of the bag and the operation of the grinder to determine whether the appropriate amount of pressure is being applied to the working surface;

e) re-positioning the axle and wheels at a second selected axle mounting location, when the contents of the bag reaches an amount, to re-adjust the amount of pressure being applied to the working surface.

35. A grinding apparatus comprising:

a) a cart having a front end and a back end, b) a hand-held grinder mounted to the cart;

c) handles located at the back end of the cart;

d) a vacuum mounted on the cart between the front and back ends;

e) a vacuum bag support located between the front and back ends of the cart;

f) wherein the cart includes a mounting configuration for mounting the hand-held grinder in either a left-facing orientation or a right-facing orientation.

36. A grinding apparatus comprising:

a) a hand-held grinder;

b) a cart having a front end and a back end, the cart further including a mounting arrangement that detachably mounts the hand-held grinder to the front end of the cart, the mounting arrangement including:

i) a first mounting mechanism and a second mounting mechanism, the first mounting mechanism fixedly mounting one end of the grinder in a laterally offset position from the cart, the second mounting mechanism being adapted to pivotally position an opposite end of the grinder at a selected vertical position to adjust the flatness of a bottom grinding surface of the hand-held grinder;

c) handles located at the back end of the cart;

d) a vacuum mounted on the cart between the front and back ends; and e) a vacuum bag support located between the front and back ends of the cart.

37. The grinding apparatus of claim 36 wherein the first mounting mechanism further includes at least one flexible member that accommodates the pivotal movement of the opposite end of the hand-held grinder to adjust the flatness of the bottom grinding surface.

38. A grinding apparatus for grinding a working surface, the grinding apparatus comprising:

a) a cart having a front region and a rear region, the cart including:

i) a base having a first side and a second side extending between the front and rear regions;

ii) at least one handle located at the rear region of the cart;

iii) a moveable wheel coupled to an axle a plurality of axle mounting locations, the axle mounting locations including:

1) at least a first and a second hole located along the first side of the base; and 2) at least a first and a second hole located along the second side of the base;

3) wherein the first hole along the first side of the base corresponds to the first hole along the second side of the base, the corresponding first holes defining a first axle mounting location;

iv) at least one wheel mounted to an axle, the axle being positioned at one of the axle mounting locations;

b) a grinder mounted at the front region of the tart, the grinder including a bottom grinding surface; and c) a vacuum assembly mounted between the front region and the rear region of the cart.

39. The grinding apparatus of claim 38, wherein the first axle mounting location defines a first fulcrum, the first fulcrum acting to transfer forces acting upon the cart to the bottom grinding surface of the grinder.

40. A grinding apparatus, comprising:

a) a cart having a front end, a back end, and sides extending between the front end and the back end;

b) a hand-held grinder detachably mounted to the front end of the cart, the grinder including a grinding surface;

c) wherein the grinder is mounted to the cart such that the grinding surface of the grinder laterally extends from only one of the sides of the cart.

41. The grinding apparatus of claim 40, wherein the hand-held grinder includes an elongated housing, the hand-held grinder being mounted to the cart such that the elongated housing is oriented in a direction traverse to a direction of operation of the cart.

42. The grinding apparatus of claim 41, wherein the hand-held grinder includes an operating switch electrically connected to a power cord.

43. The grinding apparatus of claim 40, wherein the grinder is mounted to the cart such that the grinding surface of the grinder laterally extends from a left side of the cart.

44. The grinding apparatus of claim 40, wherein the grinder is mounted to the cart such that the grinding surface of the grinder laterally extends from a right side of the cart.

* * * * *